United States Patent [19]

Manser

[11] 4,310,093

[45] Jan. 12, 1982

[54] FOLDING BOX AND BLANK FOR FABRICATING THE SAME

[75] Inventor: Karl Manser, Zurich, Switzerland

[73] Assignee: Migros Genossenschafts-Bund, Zurich, Switzerland

[21] Appl. No.: 68,387

[22] Filed: Aug. 21, 1979

[30] Foreign Application Priority Data

Aug. 21, 1978 [CH] Switzerland ..... 8847/78

[51] Int. Cl.[3] ..... B65D 5/08; B65D 5/54

[52] U.S. Cl. ..... 206/624

[58] Field of Search ..... 206/624, 625, 626; 229/44 R

[56] References Cited

U.S. PATENT DOCUMENTS

| | | | |
|---|---|---|---|
| 1,431,616 | 10/1922 | Wood | 229/44 R |
| 2,011,438 | 8/1935 | Daller | 206/624 |
| 2,094,448 | 9/1937 | Evans | 229/33 |
| 3,191,848 | 6/1965 | Meyers | 229/44 R X |
| 3,282,492 | 11/1966 | Vergobbi | 206/624 |
| 3,433,402 | 3/1969 | Persson | 229/44 R X |
| 3,653,582 | 4/1972 | Scully | 206/624 |
| 3,693,865 | 9/1972 | Desmond et al. | 229/44 R |
| 3,942,712 | 3/1976 | Bundy et al. | 206/624 |

*Primary Examiner*—Stephen P. Garbe
*Attorney, Agent, or Firm*—Charles E. Brown

[57] ABSTRACT

A folding box and blank for fabricating the same wherein the blank is formed of foldable material, typically such as cardboard or paperboard. A tuckable or insertable cover is provided which is folded out of the blank for the folding box and has a tuckable or insertable edge fitting over the open edge of the folding box.

5 Claims, 11 Drawing Figures

FIG. 1
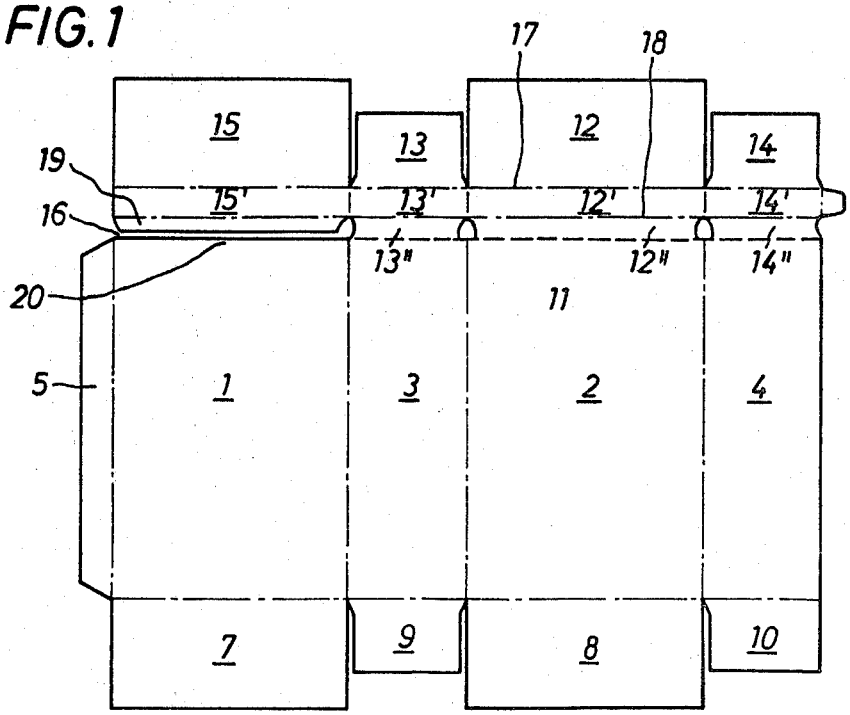
FIG. 2
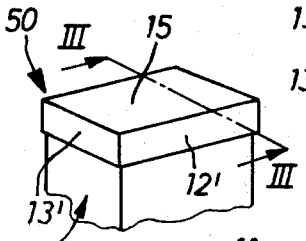
FIG. 4
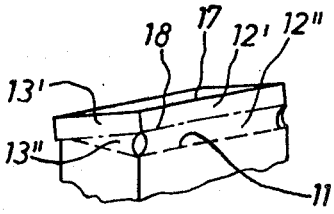
FIG. 6
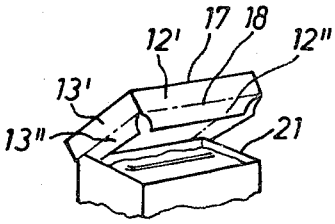
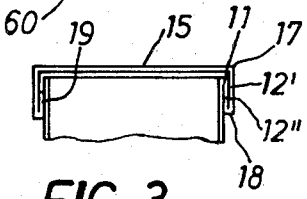
FIG. 3
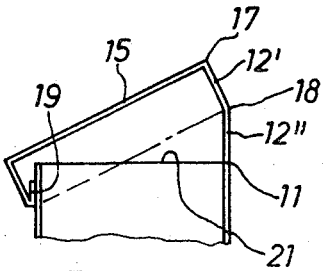
FIG. 5
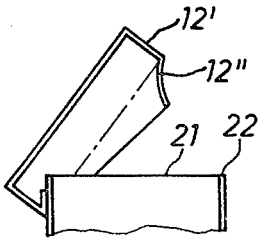
FIG. 7

FOLDING BOX AND BLANK FOR FABRICATING THE SAME

BACKGROUND OF THE INVENTION

The present invention relates to a new and improved construction of a folding box formed of a blank composed of foldable material, such as cardboard or paperboard, and further pertains to a new and improved blank for the production of such folding box or carton.

Heretofore known folding boxes of this type are structured so as to be locally tearable along tear lines or about the periphery of the folding box, in order to thus provide access to the packaged materials, such as food products or the like. After tearing there is no longer possible satisfactory sealed closing of the folding box.

SUMMARY OF THE INVENTION

Therefore, with the foregoing in mind it is a primary object of the present invention to provide a new and improved construction of folding box or carton of the previously mentioned type, which although simple in construction renders possible a satisfactory tight, repeated reclosing after the initial opening of the folding box.

Yet a further significant object of the present invention aims at the provision of a novel construction of blank for forming a folding box or carton which satisfies the immediately preceding objectives.

Still a further significant object of the present invention aims at the provision of a novel construction of folding box or carton which is simple in design, can be relatively easier fabricated, particularly in relation to a folding box having a tuckable or insertable cover formed of a separate part, yet still provides adequate sealing of the carton or box contents after the initial opening thereof.

Now in order to implement these and still further objects of the invention, which will become more readily apparent as the description proceeds, the folding box or carton of the present development is manifested by the features that it possesses a tuckable or insertable cover which is folded out of the blank forming the folding box or carton and has a tuckable cuff edge which fits over the open or top edge of the folding box.

Just as is the case with the heretofore known folding boxes or cartons, the folding box or carton of the present invention can be opened by means of a tear line. However, with the inventive folding box or carton the tear line interconnects the tuckable cuff or insertable edge with the open edge of the folding box, and the tuckable cuff edge is connected along an edge or marginal region, by means of a fixed connection, for instance, an adhesive bond, with the open edge of the folding box.

According to a further development of the folding box or carton of the invention, it is contemplated that the foldable cuff edge comprises two layers or plies. The first layer or ply defines a section forming the outer wall of the tuckable or insertable cuff edge and the second layer or ply constitutes a section defining an inner wall formed at the blank and extending, in the closed condition of the tuckable cover or carton top, between this outer wall and the upper open edge of the folding box or carton.

By means of the invention there can be provided a folding box having a tuckable or insertable cover from a single blank in a most simple manner as concerns production. The blank itself can be stacked in a space-saving manner, without there being required any special stacking or storage area for a separate cover. The tuckable box or carton cover affords an adequately tight sealing or closing of the box or carton contents against entry of light, which thus remains relatively protected even after the initial and repeated opening of the box or carton.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 illustrates a blank for constructing a folding box or carton according to the invention;

FIGS. 2, 4 and 6 are fragmentary perspective views respectively showing, in different degrees of opening, the cover side or portion of the folding box or carton;

FIGS. 3, 5 and 7 are corresponding sectional views, each taken along the line III—III of FIG. 2, of the perspective views of FIGS. 2, 4 and 6, respectively;

DETAILED DESCRIPTION OF THE PREFERRED EMBODIMENTS

Figure 8:
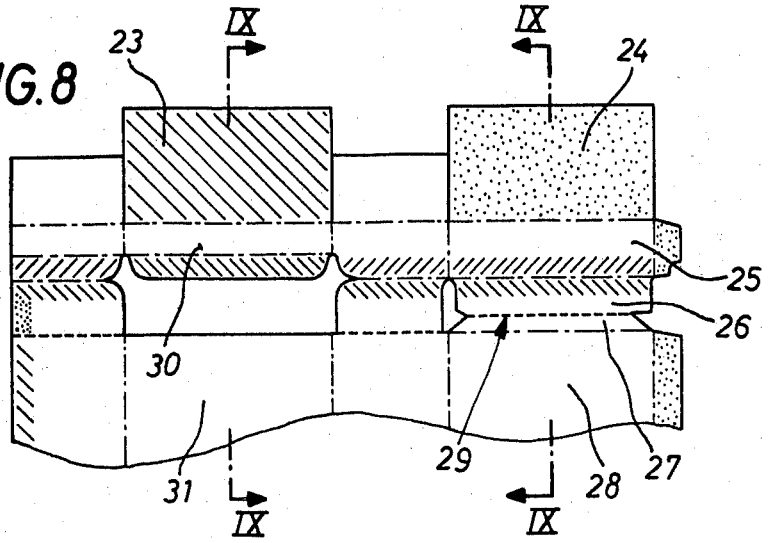
FIGS. 8 and 10 illustrate in fragmentary detail views two further constructions of blanks for forming the inventive folding boxes or cartons, only the upper portion of the modified form of inventive blanks being portrayed to simplify the illustration.

Describing now the drawings, the exemplary embodiment of blank, shown in FIG. 1, for forming a folding box or carton or other suitable container or receptacle—hereinafter simply referred to usually as folding box—will be seen to comprise a blank body having two flat sides or panels 1 and 2 and two lengthwise sides or panels 3 and 4. The flat side or panel 1 is connectable with the lengthwise or longitudinal side or panel 4 by means of a suitable connecting tab or tongue 5, constituted by for instance an adhesive tab or flap 5. The base flaps or panels 7, 8, 9, and 10 prolong the flat sides or panels 1, 2 and the lengthwise sides or panels 3, 4 respectively, and after appropriate folding, if necessary also adhesive bonding, form the folding box base or floor of the box body.

The sides or panels 2, 3 and 4 merge, by means of a common tear line 11 or equivalent structure with related cover flaps or panels 12, 13 and 14, respectively. At the lateral cover flap or panel 13 there is attached, so as to hang in a cantilever-like fashion, a further cover flap or panel 15 separated by a gap or space 16 from the related flat side or panel 1.

All four of the cover flaps or panels 12, 13, 14 and 15 are provided at their lower region with two continuous, essentially parallel, horizontal fold or folding edges 17 and 18, extending essentially in parallelism with the tear line 11. Below the folding edge 18 there is formed an adhesive or connection tab or flap 19 at the region of the cover flap or panel 15.

For forming the box cover the cover flaps or panels 12 to 15 initially are downwardly folded about the tear line 11 shown in FIG. 1. Then the cover flaps or panels 12 to 15 are again folded back about the fold or folding edge 18. The connecting or adhesive tab or flap 19 is connected, as by adhesive bonding, externally, in its unfolded condition, at the region neighboring the upper edge of the flat side or panel 1, thereby producing a fixed or firm connection between the cover panel 15 and the flat side or panel 1. The region of the cover flaps or panels 12, 13, 14 and 15, delimited between the folding edges 17 and 18, and designated by the same reference characters, however modified by a prime marking (′), namely 12′, 13′, 14′ and 15′, form the outer wall of the tuckable cuff edge of a tuckable box cover, generally indicated in FIG. 2 by reference character 50. On the other hand the region between the folding edge 18 and the tear line 11 likewise designated with the same reference characters as the associated cover flaps or panels 12, 13, 14 and 15, but again however modified by two prime markings (″), namely parts 12″, 13″, 14″ and 15″, form the inner wall of the tuckable cuff edge of the tuckable box cover for the box body, generally indicated by reference character 60 in FIG. 2.

The appearance of such tuckable or mountable box cover in its respective closed, half-opened and completely opened condition, has been shown quite clearly in FIGS. 3, 5 and 7.

In its not yet opened position the tuckable or mountable cover 50 is suspended in straddling fashion at the box body 60 of the folding box, by means of the adhesive flap or tab 19 and the not yet torn tear line 11 over the entire circumference of the folding box. Upon initial opening of the folding box the tuckable cover 50, as best seen by referring to FIG. 5, is tilted upwardly about the adhesive flap 19, which also acts as a hinge upon subsequent reopening and closing of the folding box, until there has been reached the condition shown in FIG. 5. In this condition the box portions or sections, in other words, the panels or flaps 12′, 12″; 13′, 13″ and 14′, 14″ still depend, by means of the tear line 11 at the upper open edge of the folding box, this open or top edge having been conveniently designated by reference characters 21 in FIGS. 5 to 7, but such panels or flaps are in their extended as opposed to their prior overlying state. Further upward tilting of the tuckable or mountable cover leads to a tearing action occurring between the panel portions 12″, 13″, 14″ and the sides or panels 2, 3 and 4, respectively, along the tear line 11. It will be apparent that upon renewed closing the circumferential edges 22 of the upper open or top edge 21 of the folding box again inwardly press the regions 12″, 13″ and 14″ towards the outer wall regions or panel portions 12′, 13′ and 14′, thereby realizing a relatively tight closure of the packaged goods or materials, even after the initial opening of the folding box.

The folding box of the present invention can be fabricated more simply than a box having a tuckable or mountable cover fabricated from a separate part. However, the inventive box and its box cover, just as in the case of the prior art mountable or tuckable covers fabricated from a separate part, affords the possibility of again reclosing the folding box, after its initial opening, in such a manner that there can be realized satisfactory sealing or closing of the material or product remaining in the folding box.

Figure 9:
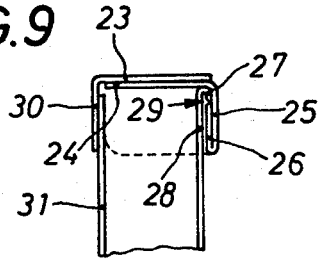
FIGS. 9 and 11 are fragmentary sectional views showing the folding boxes or cartons folded together from the respective blanks of FIGS. 8 and 10, the sectional view of FIG. 9 being taken essentially along the sectional line IX—IX of FIG. 8 and the sectional view of FIG. 11 being taken essentially along the sectional line XI—XI of FIG. 10.
Figure 11:
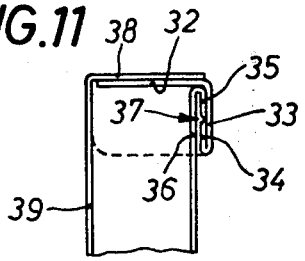
Figure 10:
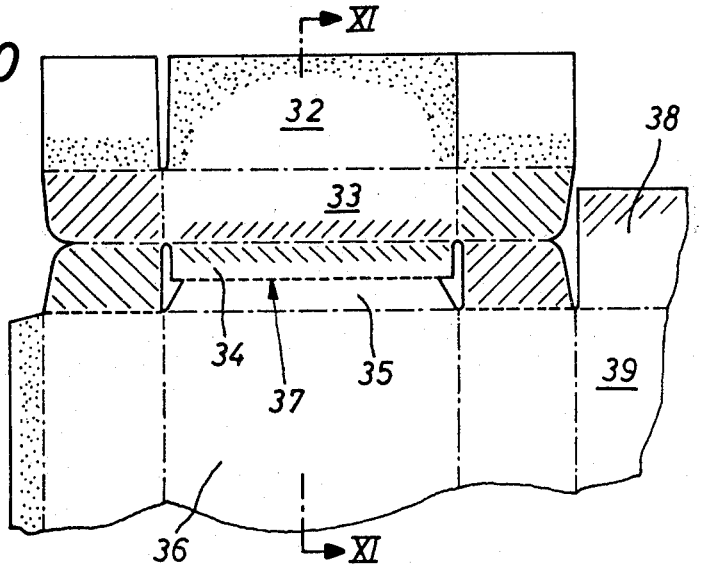

Finally, FIGS. 8 to 11 show two further exemplary embodiments of inventive folding boxes and blanks for forming the same, wherein the tuckable or mountable cover thereof likewise is formed from a single box blank.

The chain-dot lines designate the folding or fold lines, the broken lines designate the tear or tear-off locations, respectively, and the full lines, cutouts.

The blanks have been shown in top plan view at their inner surface or side.

The shaded zones are covered with a suitable adhesive, such as glue, at the inner surface, whereas the panels containing the point-like locations have adhesive, again typically glue, applied to the rear or outer side.

In the corresponding drawings there have been conveniently designated throughout the identical parts or panels, flaps and tabs, with the same reference characters.

While there are shown and described present preferred embodiments of the invention, it is to be distinctly understood that the invention is not limited thereto, but may be otherwise variously embodied and practised within the scope of the following claims. Accordingly,

What is claimed is:

1. A blank for a box, said blank being formed of foldable sheet material, and is divided by longitudinal fold lines to define two face sides and two end sides in alternating relation, transverse fold and tear lines at one end of said sides and, in cooperation with extensions of said longitudinal fold lines and cutouts aligned with said longitudinal fold line extensions, defining in longitudinal alignment with each end side and one of said face sides a connecting flap, a cover side panel and a cover flap, and in alignment with the other of said face sides a cover side panel and a cover panel, there being a transverse cutout between said other face side and the respective one of said cover side panels, and all of said cover side panels being of the same dimension longitudinally of said blank.

2. A blank according to claim 1 wherein all of said cover side panels are joined to respective ones of said cover panel and said cover flaps along a continuous one of said transverse fold lines.

3. A blank according to claim 2 wherein said connecting flap of said one face side is divided into two parts by one of said transverse tear lines.

4. A blank according to claim 2 wherein all of said connecting flaps are joined to respective ones of said end and face sides by a continuous one of said transverse tear lines.

5. A blank according to claim 2 wherein said cover panel cover side panel has a connecting flap, and all of said connecting flaps are joined to respective ones of said cover side panels by a continuous one of said transverse fold lines.

* * * * *